US009002226B2

(12) United States Patent
Hamada

(10) Patent No.: US 9,002,226 B2
(45) Date of Patent: Apr. 7, 2015

(54) DEVELOPING DEVICE AND IMAGE FORMING APPARATUS

(75) Inventor: Toshimasa Hamada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 540 days.

(21) Appl. No.: 13/231,242

(22) Filed: Sep. 13, 2011

(65) Prior Publication Data

US 2012/0070170 A1 Mar. 22, 2012

(30) Foreign Application Priority Data

Sep. 22, 2010 (JP) ..... 2010-212146

(51) Int. Cl.
*G03G 15/06* (2006.01)
*G03G 15/08* (2006.01)
*G03G 15/00* (2006.01)

(52) U.S. Cl.
CPC ..... *G03G 15/556* (2013.01); *G03G 15/0851* (2013.01); *G03G 15/55* (2013.01)

(58) Field of Classification Search
CPC ..... G03G 13/08; G03G 15/0824; G03G 2215/0614
USPC ..... 399/29, 53, 55, 281, 283, 285
See application file for complete search history.

(56) References Cited

U.S. PATENT DOCUMENTS 4,536,080 A * 8/1985 Hauser et al. ..... 399/29
5,473,417 A 12/1995 Hirano
6,917,780 B2 * 7/2005 Ozawa et al. ..... 399/282

FOREIGN PATENT DOCUMENTS

JP 6-194944 7/1994
JP 06242673 A * 9/1994
JP 9-197943 7/1997
JP 10020672 A * 1/1998
JP 2005258386 A * 9/2005
JP 2005-308899 11/2005

OTHER PUBLICATIONS

Shimizu (JP 2005-258386 A), Sep. 2005, JPO Machine Translation.*

* cited by examiner

*Primary Examiner* — Erika J Villaluna
(74) *Attorney, Agent, or Firm* — Nixon & Vanderhye P.C.

(57) ABSTRACT

A developing device which includes a developing roller which supplies a toner to a photoreceptor and a supply roller which performs supply of a toner to the developing roller and peeling of a toner from the developing roller, and applies a bias voltage to the developing roller so as to develop an electrostatic latent image formed on the photoreceptor with a toner. The developing device includes a first current measuring portion which measures a value of a current flowing in the developing roller, a second current measuring portion which measures a value of a current flowing in the supply roller, and a control portion which calculates a toner charging amount on the developing roller and a toner peeled amount by the supply roller based on measured results by the first current measuring portion and the second current measuring portion.

15 Claims, 6 Drawing Sheets

DEVELOPING DEVICE AND IMAGE FORMING APPARATUS

CROSS-NOTING PARAGRAPH

This non-provisional application claims priority under 35 U.S.C. §119(a) on Patent Application No. 2010-212146 filed in JAPAN on Sep. 22, 2010, the entire contents of which are hereby incorporated herein by reference.

FIELD OF THE INVENTION

The present invention relates to a developing device of a single-component system which develops an electrostatic latent image formed on an electrostatic latent image carrier with a toner, and an image forming apparatus provided with the developing device.

BACKGROUND OF THE INVENTION

In an electrophotographic image forming apparatus, a developing method is employed in which for example, a surface of an electrostatic latent image carrier of a photoreceptor or the like is charged, the charged region is exposed according to image information to form an electrostatic latent image, and the electrostatic latent image is developed to be visualized (developed). Such a developing method includes a single-component developing system which uses only a toner as a developer, without using a carrier.

A main configuration of the developing device includes a developing roller for developing a toner on a photoreceptor, a supply roller for performing supply of a toner to the developing roller and scraping (peeling) of a toner from the developing roller, and a toner layer regulation blade for regulating the toner supplied from the supply roller to the developing roller to a predetermined amount.

In the developing device as described above, the stability is regarded as the biggest challenge. Therefore, it is important to detect variation in a charging amount due to change of a toner, toner peeling failure due to surface hardening of the supply roller and the like.

For example, Japanese Laid-Open Patent Publication No. 9-197943 describes a developing device (process cartridge) which measures a current flowing between a developing roller and a conductive supply roller in contact with the developing roller, thereby detecting deterioration in the supply roller so as to issue a warning to a user before occurrence of image failure.

In the developing device described in the above Japanese Laid-Open Patent Publication No. 9-197943, it is focused on that there is interrelation between aggravation of adhesiveness between the supply roller and the developing roller caused by occurrence of surface wear of the supply roller and fraying of a foamed cell in the case of performing massive amount of printing, and a value of a current flowing between the supply roller and the developing roller. That is, when the adhesiveness between the supply roller and the developing roller gets worse, the flowing current reduces, which therefore is described to be usable to detect deterioration in the supply roller.

However, the value of the current flowing between the developing roller and the supply roller is influenced by two values of a toner charging amount of the developing roller and a toner peeled amount by the supply roller. When only the value of the current flowing between the developing roller and the supply roller is measured, it is indistinguishable whether variation in the values is due to a change in the toner charging amount of the developing roller or a change in the toner peeled amount of the supply roller. Accordingly, there is a possibility to be judged, for example, even when there is actually the change in the toner charging amount, that the toner peeled amount is changed so as to cause an erroneous operation such as emitting an exchange signal of the supply roller, thereby posing a problem that process control and deterioration detection of the supply roller and the like are not able to be performed appropriately.

SUMMARY OF THE INVENTION

An object of the present invention is to provide a developing device with excellent stability in which a value of a current flowing in each of a developing roller and a supply roller is measured so that appropriate process control and deterioration detection of the supply roller or the like are performed, and an image forming apparatus provided with the developing device.

An object of the present invention is to provide a developing device of a single-component system which includes a developing roller which supplies a toner to an electrostatic latent image carrier and a supply roller which performs supply of a toner to the developing roller and peeling of a toner from the developing roller, and applies a bias voltage to the developing roller so as to develop an electrostatic latent image formed on the electrostatic latent image carrier with the toner, comprising: a first current measuring portion which measures a value of a current flowing in the developing roller; a second current measuring portion which measures a value of a current flowing in the supply roller; and a control portion which calculates a toner charging amount on the developing roller and a toner peeled amount by the supply roller based on measured results by the first current measuring portion and the second current measuring portion.

Another object of the present invention is to provide the developing device, wherein an image density adjustment portion which adjusts the bias voltage applied to the developing roller so that an image developed on the electrostatic latent image carrier is a predetermined density is provided, and the first current measuring portion and the second current measuring portion measure, after adjustment of an image density performed by the image density adjustment portion, a value of a current flowing in each of the developing roller and the supply roller.

Another object of the present invention is to provide the developing device, wherein in a case where same bias voltages are applied to the developing roller and the supply roller at the time of printing, the first current measuring portion and the second current measuring portion measure a value of a current flowing in the developing roller and a value of a current flowing in the supply roller, respectively at the time of printing, so that the control portion calculates the toner charging amount and the toner peeled amount based on the two measured current values.

Another object of the present invention is to provide the developing device, wherein in a case where different bias voltages are applied to the developing roller and the supply roller at the time of printing, a value of a current flowing in the supply roller is measured in advance at the time of non-printing by the second current measuring portion in a state where the same bias voltages are applied to the developing roller and the supply roller, and the first current measuring portion and the second current measuring portion measure a value of a current flowing in the developing roller and a value of a current flowing in the supply roller, respectively at the time of printing, so that the control portion calculates the toner charging amount based on the two measured current values as well as calculates the toner peeled amount based on the toner charging amount and the value of the current of the supply roller which is measured in advance at the time of non-printing.

Another object of the present invention is to provide the developing device, wherein in a case where the toner charging amount calculated by the control portion is reduced to less than a predetermined amount, recovery of deterioration in the toner is performed.

Another object of the present invention is to provide the developing device, wherein the recovery of the deterioration in the toner is processing in which the deteriorated toner is forcibly consumed and a new toner is replenished.

Another object of the present invention is to provide the developing device, wherein in a case where the toner peeled amount calculated by the control portion is reduced to less than a predetermined amount, a signal to prompt exchange of the development device is emitted.

Another object of the present invention is to provide the developing device, wherein the developing roller is in non-contact with the electrostatic latent image carrier.

Another object of the present invention is to provide the developing device, wherein the bias voltage applied to the developing roller is a direct current voltage.

Another object of the present invention is to provide the developing device, wherein a toner layer regulation blade for regulating the toner supplied to the developing roller to a predetermined amount is provided and a surface of the toner layer regulation blade on a side of the developing roller has insulation properties.

Another object of the present invention is to provide an image forming apparatus comprising the developing device.

PREFERRED EMBODIMENTS OF THE INVENTION

Figure 1:
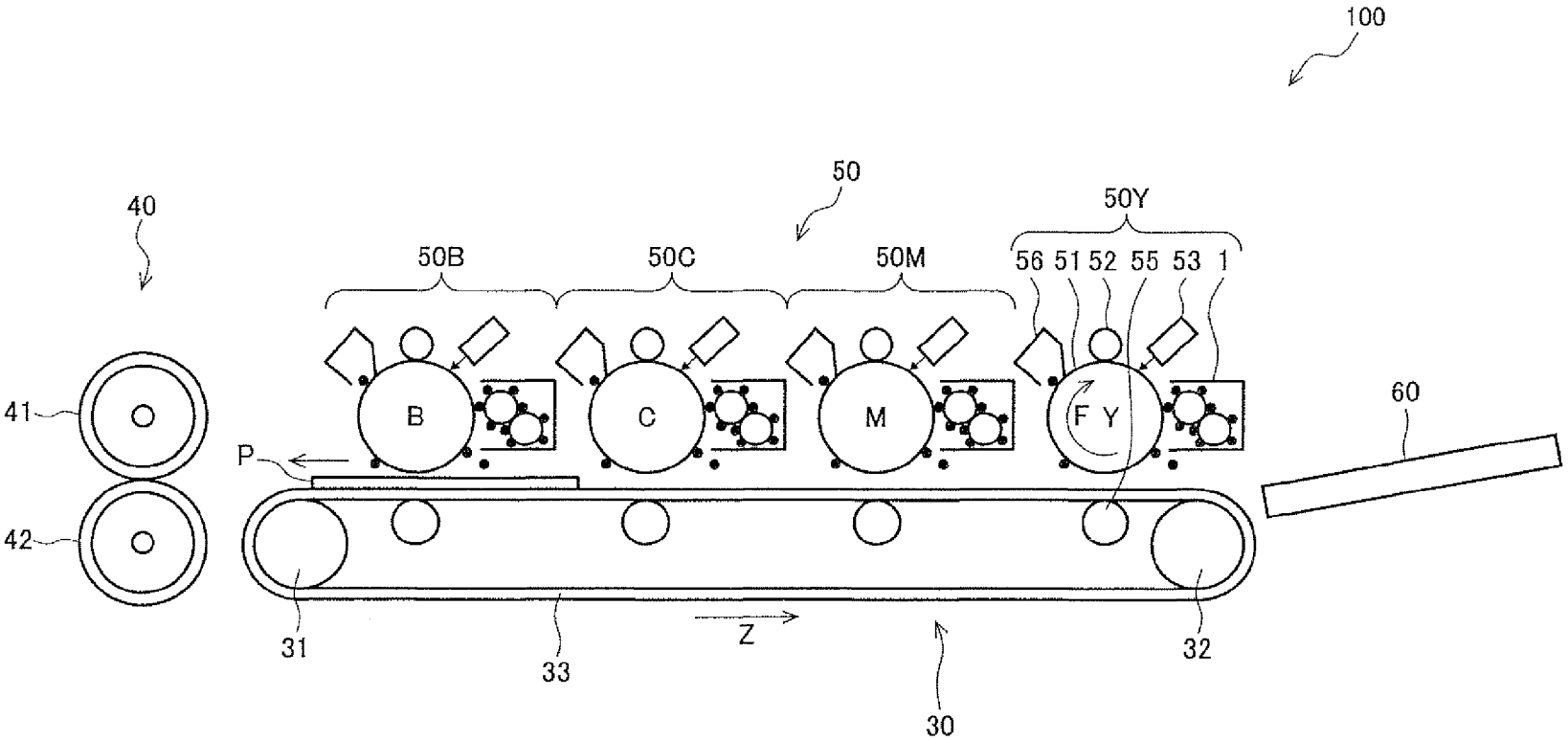
FIG. 1 is a schematic view showing a configuration example of main portions of an image forming apparatus according to an embodiment of the present invention.

Now, referring to the drawings, embodiments of the present invention will hereinafter be described in detail. Note that, repetition in description for a configuration element having substantially the same function will be omitted by adding the same reference numeral in the present specification and drawings.

(First Embodiment)

FIG. 1 is a schematic view showing a configuration example of main portions of an image forming apparatus according to an embodiment of the present invention. In the drawing, a numeral 100 shows an image forming apparatus. Note that, in this example, main configuration elements of the image forming apparatus 100 are focused on and simplified to be described.

The image forming apparatus 100 is a color image forming apparatus of a tandem system which includes four photoreceptors 51, corresponding to an electrostatic latent image carrier, for a yellow image, a magenta image, a cyan image and a black image, and is capable of forming a color image with these. The image forming apparatus 100 has a printer function for forming a color image or a monochrome image for a sheet P which is a transferred material (recording medium) based on image data transmitted from various terminal apparatuses such as a PC (Personal Computer) connected via a network and image data read out by a document reading device such as a scanner.

As shown in FIG. 1, the image forming apparatus 100 includes image forming station portion 50 (50Y, 50M, 50C, 50B) having a function to form a toner image on the paper P, a fixing device 40 having a function to fix a toner image formed on the sheet P in the image forming station portion 50, and a conveyance portion 30 having a function to convey the sheet P from a feed tray 60 on which the sheet P is placed to the image forming station portion 50 and to the fixing device 40.

The image forming station section 50 is configured with four image forming stations 50Y, 50M, 50C, and 50B for a yellow image, a magenta image, a cyan image, and a black image, respectively. Specifically, the yellow image forming station 50Y, the magenta image forming station 50M, the cyan image forming station 50C, and the black image forming station 50B are disposed in this order from a side of the feed tray 60 between the feed tray 60 and the fixing device 40.

The image forming stations 50Y, 50M, 50C, and 50B for the respective colors have substantially the same structure, except a toner type, and form yellow, magenta, cyan, and black toner images according to image data corresponding to the respective colors so that the images are finally transferred onto the sheet P serving as a recording medium.

The image forming station portion 50 of the present embodiment has a configuration to form images in four colors of yellow, magenta, cyan, and black, but not particularly limited to these four colors, and may have a configuration to form toner images in six colors additionally including, for example, light cyan (LC) and light magenta (Lm) that have the same color hues as cyan and magenta and have a lower density.

Note that, as to reference numerals for the components of the respective image forming stations in FIG. 1, those for the yellow image forming station 50Y are described as a representative, and the reference numerals for the components of the other respective image forming stations 50M, 50C, and 50B are omitted.

The respective image forming stations 50Y, 50M, 50C, and 50B include photoreceptors 51 serving as an electrostatic latent image carriers on which an electrostatic latent image is formed, and around the photoreceptors 51, charging devices 52, exposure devices 53, developing devices 1, transfer rollers 55, and cleaning devices 56 are disposed in the circumferential direction.

The photoreceptor 51 in the shape of a nearly cylindrical drum is provided with a photosensitive material such as an OPC (Organic Photoconductor) on the surface thereof, and is disposed below the exposure device 53 and controlled so as to be rotationally driven in a predetermined direction (direction shown with an arrow F in the drawing) by driving means and control means (not shown).

The charging device 52 is charging means for uniformly charging the surface of the photoreceptor 51 to a predetermined potential, and is disposed above the photoreceptor 51 so as to be close to an outer periphery surface thereof. In the present embodiment, a roller-type charging roller of a contact type is used, but a charging device of a charger type, a brush type, an ion emission-charging type and the like may be used.

The exposure device 53 has a function of exposing the surface of the photoreceptor 51 that is charged with the charging device 52 by being irradiated with laser light based on image data output from an image processing portion (not shown), thereby writing an electrostatic latent image according to the image data on the surface of the photoreceptor 51. The exposure device 53 forms an electrostatic latent image in a corresponding color when image data that corresponds respectively to yellow, magenta, cyan, or black is input, according to each of the image forming stations 50Y, 50M, 50C, or 50B. As the exposure device 53, a laser scanning unit (LSU) including a laser irradiation portion and a reflection mirror or a writing device (for example, a write head) in which light emitting elements such as ELs and LEDs are arranged in an array is usable.

The developing device 1 has a developing roller corresponding to a developer carrier that carries developer. The developing roller is configured so that the developing roller comes close to the photoreceptor 51, and a developer is conveyed to a development region in which a toner can move to the photoreceptor 51. In this embodiment, the developing device 1 is a so-called one-component developing device that uses a toner as a developer, and forms a toner image (visible image) by developing an electrostatic latent image that has been formed on the surface of the photoreceptor 51 by the exposure device 53.

The developing device 1 contains a yellow, magenta, cyan, or black developer according to image formation of the respective image forming stations 50Y, 50M, 50C, and 50B. The developer includes a toner that is charged with a homopolarity as the surface potential of the charged photoreceptor 51. Note that, the polarity of the surface potential of the photoreceptor 51 and the charged polarity of the toner to be used are, although may be either positive or negative, both negative (minus) in the present embodiment.

The transfer roller 55 transfers a toner image formed on the photoreceptor 51 onto the surface of a sheet P that is conveyed by a conveyance belt 33, and is provided with a transfer roller to which a bias voltage that has a polarity (positive (plus) polarity in the present embodiment) opposite to the charged polarity of the toner is applied.

The cleaning device 56 removes and collects the toner remaining on the outer periphery surface of the photoreceptor 51 after transferring a toner image onto the sheet P. In the present embodiment, the cleaning device 56 is arranged at a nearly opposing position to the developing device 1 with the photoreceptor 51 therebetween, and on a side of the photoreceptor 51.

The conveyance portion 30 includes a driving roller 31, a driven roller 32, and the conveyance belt 33, and conveys the sheet P onto which toner images in the respective colors are transferred in each of the image forming stations 50Y, 50M, 50C, and 50B. The conveyance portion 30 is configured so that the endless conveyance belt 33 is stretched out between the drive roller 31 and the driven roller 32, and conveys the sheet P supplied from a feed tray 60 to each of the image forming stations 50Y, 50M, 50C, and 50B sequentially.

The fixing device 40 includes a heat roller 41 and a pressure roller 42, and by conveying the sheet P to a nip portion in which the heat roller 41 is in abutment with the pressure roller 42, thermal compression bonds the toner image transferred onto the sheet P to be fixed on the sheet P.

In the image forming apparatus 100 in such a configuration, when the sheet P that is conveyed by the conveyance portion 30 passes through a position opposed to the photoreceptor 51 of the respective image forming stations 50Y, 50M, 50C, and 50B, the toner images on the respective photoreceptors 51 are successively transferred onto the sheet P with the action of a transfer electric field of the transfer rollers 55 that is disposed below the opposing positions through the conveyance belt 33. This allows toner images in the respective colors to be transferred so as to be layered on the sheet P, and a desired full-color image is formed on the sheet P. The sheet P on which the toner image is transferred in such a manner is subjected to fixing processing of the toner image at the fixing device 40 and thereafter is fed out to a discharge tray.

Figure 2:
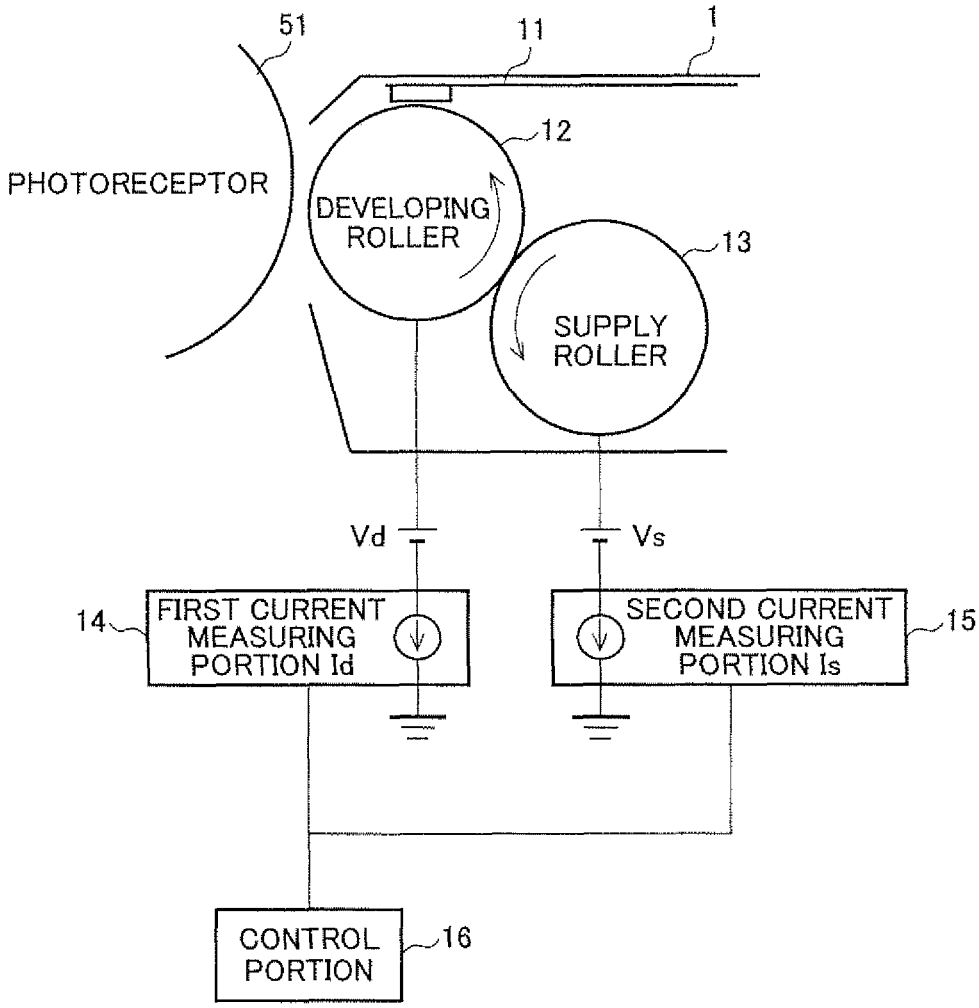
FIG. 2 is a schematic view showing a configuration example of a developing device of the present invention.

Next, description will be given in detail for a configuration example of the developing device 1. FIG. 2 is a schematic view showing a configuration example of the developing device 1 provided in the image forming station portion 50 shown in FIG. 1. The developing device 1 includes a toner layer regulation blade 11, a developing roller 12 and a supply roller 13. The developing roller 12 holds a development gap with the photoreceptor 51. The development gap is held to be 150 to 500 μm by a gap holding member (not shown). The supply roller 13 contacts the developing roller 12 in a nip portion. The developing roller 12 is made of aluminum and the like, and is configured to have surface roughness of Ra 0.3 to 0.6 μm. The supply roller 13 forms polyurethane expanded foam around a metal shaft, and an interlocking amount between the developing roller 12 and the nip portion is 0.2 to 1.0 mm. A rotation direction of the developer 12 and the supply roller is set opposite to the rotation direction of the photoreceptor 51. Although it is not shown, a toner stirring roller is provided for stirring a toner to be conveyed to the supply roller 13.

The toner layer regulation blade 11 is comprised of a plate and a rubber layer. The plate of the toner layer regulation blade 11 is formed of phosphor bronze with a thickness of 0.1 to 0.2 mm, and a rubber layer at a tip end portion thereof is composed of elastic rubber formed of urethane or the like with a thickness of about 1 to 2 mm.

A toner has a core which is made of polyester, and 1 to 3 wt % of silica and 1 to 2 wt % of titanium oxide, which are external additives, are added thereto, respectively. The toner conveyed by the stirring roller to the supply roller 13 is scraped with the developing roller 12 at the nip portion, whereby the toner is scooped up to the developing roller 12 so that a toner layer is formed. Next, the toner, when passing through the rubber layer of the toner layer regulation blade 11, is charged again while a layer thereof is regulated by a pressure from the blade. For the toner which has passed through the blade, development is performed on the photoreceptor 51 so that a latent image is visualized according to a voltage applied to the developing roller 12 and a latent image potential on the photoreceptor 51.

A main characteristic portion of the present invention is to provide a developing device excellent in stability in which appropriate process control and deterioration detection of a supply roller and the like are performed by measuring a value of a current flowing in each of the developing roller and the supply roller. For such a configuration, the developing device 1 includes a developing roller 12 which supplies a toner to the photoreceptor 51, a supply roller 13 which performs supply of a toner to the developing roller 12 and peeling of a toner from the developing roller 12, a first current measuring portion 14 which measures a value of a current flowing in the developing roller 12, a second current measuring portion 15 which measures a value of a current flowing in the supply roller 13, and a control portion 16 which calculates a toner charging amount on the developing roller 12 and a toner peeled amount by the supply roller 13 based on measured results by the first current measuring portion 14 and the second current measuring portion 15. Both the first current measuring portion 14 and the second current measuring portion 15 are provided through a power source till reaching GND therebetween.

In FIG. 2, a DC voltage Vd is applied to the developing roller 12. To the developing roller 12 and the toner layer regulation blade 11, a same bias voltage is applied mostly. Further, there are a case where a same bias voltage as that of the developing roller 12 is applied to the supply roller 13, and a case where a direct current potential difference of about 50 V to 200 V is provided so that a toner is easily shifted from the supply roller 13 to the developing roller 12. Description for the case where the voltage Vs applied to the supply roller 13 and the voltage Vd applied to the developing roller 12 are the same will be given below.

Consideration is made on a flow of a current when a toner is not consumed in the configuration shown in FIG. 2. The toner layer regulation blade 11 is comprised of a metallic plate and elastic rubber such as urethane or the like, and since the elastic rubber has insulation properties, a current hardly flows therein. Moreover, the developing roller 12 is in non-contact with the photoreceptor 51, therefore when there is no toner consumption due to printing, the current will not flow to a side of the photoreceptor 51. Therefore, when the current in this case is measured, assuming that the current that flows in the developing roller 12 is Id and the current that flows in the supply roller 13 is Is, Id+Is=0, namely, the current flows only between the developing roller 12 and the supply roller 13. The current that flows in the developing roller 12 at this time is assumed to I (0), and the following formula is satisfied.

$$I(0)=-Is \qquad \text{formula (1)}$$

Description will be given below for a reason why this formula (1) is satisfied.

Figure 3:
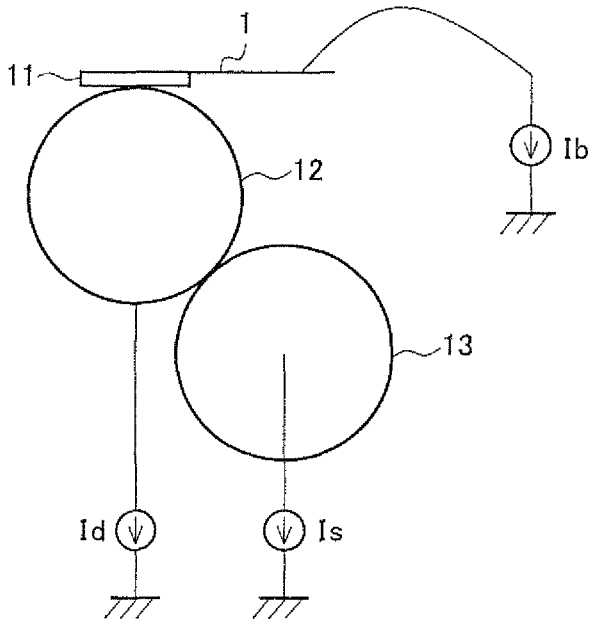
FIG. 3 is a view in which the configuration of the developing device shown in FIG. 2 is modeled to be shown.
Figure 4:
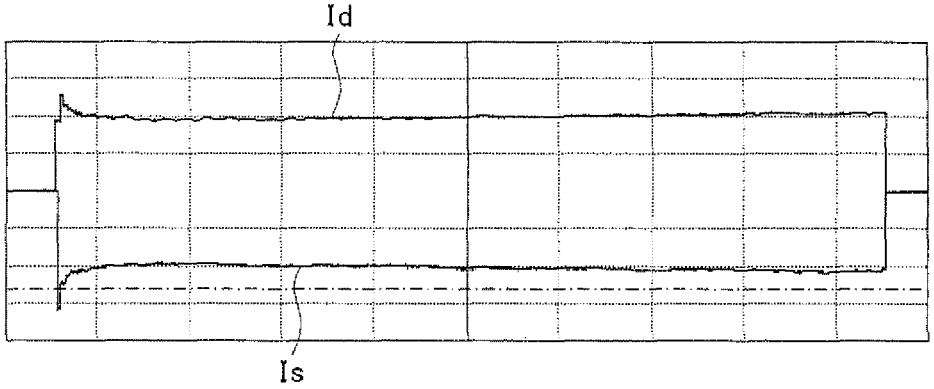
FIG. 4 is a view showing actual measured results of a current Id and a current Is when a toner is not consumed.

FIG. 3 is a view in which the configuration of the developing device 1 shown in FIG. 2 is modeled to be shown. In the drawing, Id denotes a current flowing in the developing roller 12, Is denotes a current flowing in the supply roller 13, and Ib denotes a current flowing in the toner layer regulation blade 11. When a current is measured actually in this model (system), the toner layer regulation blade 11 is with an insulation object such as urethane or the like as an intermediate, thus a current hardly flows. Therefore, it is assumed Ib≈0. In FIG. 4, actual measured results of the current Id and the current Is when the toner is not consumed are shown.

Figure 5:
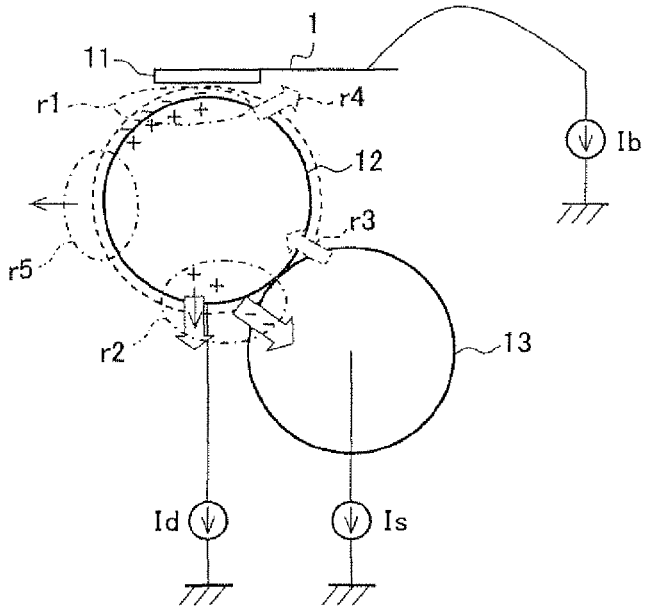
FIG. 5 is a view for explaining a current pathway in the model of FIG. 3.

FIG. 5 is a view for explaining a current pathway in the model of FIG. 3. First, with a rotation of the developing roller 12, due to frictional charging between the developing roller 12 and the toner, a negative charge is transferred to a toner and a positive charge is transferred onto a surface of the developing roller 12 (r1). The negative charge of the toner and the positive charge of the developing roller 12 are attracted to each other so as to proceed to a downstream side with the rotation of the developing roller 12. In a case where development is not performed on the photoreceptor, the toner is peeled off by the supply roller 13 entirely, and the positive charge remains on the developing roller 12 so as to flow as a positive current. Moreover, the supply roller 13 receives the negative charge of the toner and a negative current flows therein (r2). Both of these currents are due to scraping of the toner by the supply roller 13, and absolute values thereof are the same.

Based on the above reason and the measured results of FIG. 4, Id=−Is, and it is considered that the above formula (1) is satisfied. Note that, exchange of a toner between the supply roller 13 and the developing roller 12 includes, other than the above, scooping up of the toner by the supply roller 13 (r3), and scraping from the developing roller 12 due to regulation of a toner amount by toner layer regulation blade 11 (r4). However, these are considered to be an ignorable level, since the toner charging amount is small, and the both sides balance so that the influence thereof is small.

Further, at the time of printing, the toner moves to a side of the photoreceptor at a part shown in r5 of FIG. 5, and therefore, the positive charge remains on the developing roller 12 so as to be added to the current Id as the positive current. Hereinafter, description will be given for a case where printing is performed.

In this case, an amount of occurrence of charge transfer from the developing roller 12 to the photoreceptor 51 associated with the movement of the toner is measured as a current. The current value I (1) at this time is represented by the following formula.

$$I(1)=a\times b\times c\times d\times e\times h\div k\times 10^{-11}[A] \qquad \text{formula (2)}$$

where a [mg/cm2] is a toner adhesive amount on the developing roller, b [μC/g] is a toner average charging amount on a developing roller, c [mm] is a width in a printing portion, d is a printing ratio, e is a development efficiency, h [mm/sec] is a circumferential speed of the photoreceptor drum, and k is a circumferential speed of the developing roller/a circumferential speed of the photoreceptor drum.

As an example, assuming a case where the toner adhesive amount on the developing roller a is 0.6 [mg/cm2], the toner average charging amount on the developing roller b is 10 [μC/g], the width in the printing portion c is 214 [mm], the printing ratio d is 20%, the development efficiency e is 80%, the circumferential speed of the photoreceptor drum h is 150 [mm/sec], and the circumferential speed of the developing roller/the circumferential speed of the photoreceptor drum k is 1.0, the above-described current I (1) is able to be obtained as about 0.31 μA.

Here, a value of the current flowing at the time of peeling a toner from the developing roller 12 by the supply roller 13 is changed depending on the printing ratio. A value of the current flowing in the developing roller 12 due to toner peeling has an absolute value the same as that of the current flowing in the supply roller 13 due to toner peeling, and signs thereof are opposite to each other. Therefore, the current Id flowing in the developing roller 12 at the time of printing is able to be represented by the following formula.

$$Id=I(1)-Is \qquad \text{formula (3),thereby,}$$

$$I(1)=Id+Is \qquad \text{formula (4).}$$

Note that, the printing ratio in actual printing is not constant and changes variously. Accordingly, the values of Id and Is vary with time. Therefore, it is effective to measure Id and Is as an average value in a given time. That is, Id and Is may be replaced with Ida and Isa as shown below.

$$Ida=1/\Delta t\times\int(Id)dt \qquad \text{formula (5)}$$

$$Isa=1/\Delta t\times\int(Is)dt \qquad \text{formula (6)}$$

where Δt is a measurement time.

Figure 6:
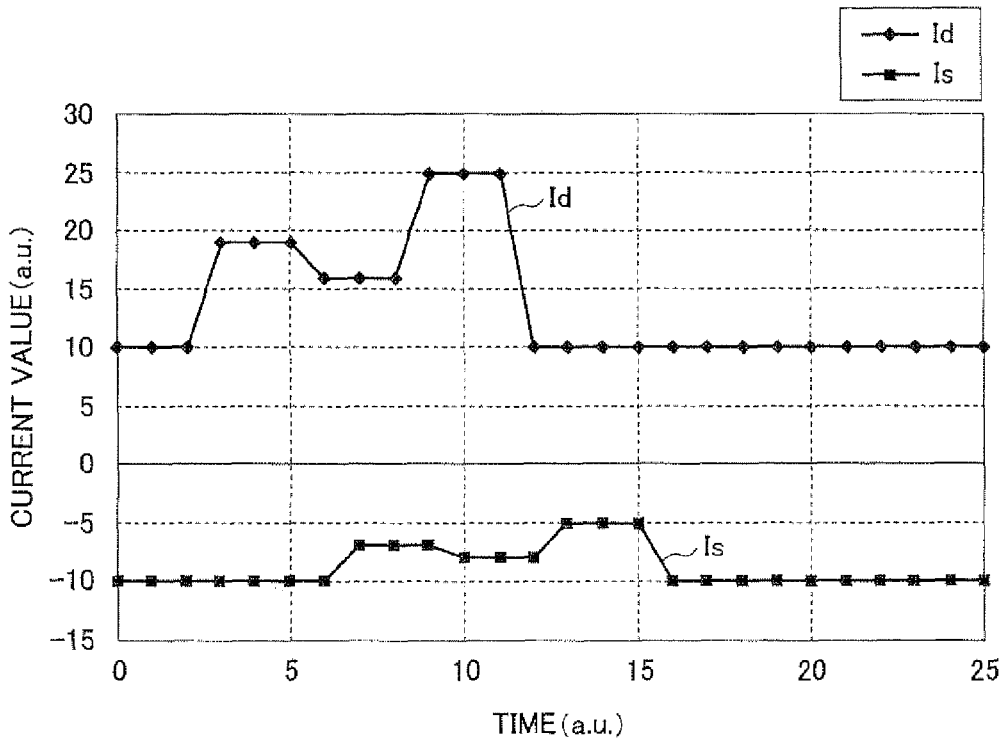
FIG. 6 is a view showing an example of variation of a current value when a printing ratio is changed in the middle.

In FIG. 6, variation in a value of a current when the printing ratio is changed in the middle is shown. The current value of the supply roller 13 varies slightly behind the variation of the current flowing in the developing roller 12. This is a time difference occurred due to a given time required until a part on the developing roller 12 in which a toner has been moved to the photoreceptor 51 comes in contact with the supply roller 13.

In FIG. 6, an average current in time 0 to 18 is Id=14.7, and Is=−8.4. Note that, the unit for both the current value in a vertical axis and the time in a horizontal axis is (a.u.) which shows an arbitrary unit.

Here, since the average printing ratio d is able to be obtained from dot information of data, from the former parameters and the formula (2) and the formula (4) as described above, the toner average charging amount b is able to be represented by the following formula.

$$b=(Id+Is)\div(a\times c\times d\times e\times h)\times k\times 10^{11}\,[\mu C/g] \qquad \text{formula (7)}$$

Figure 7:
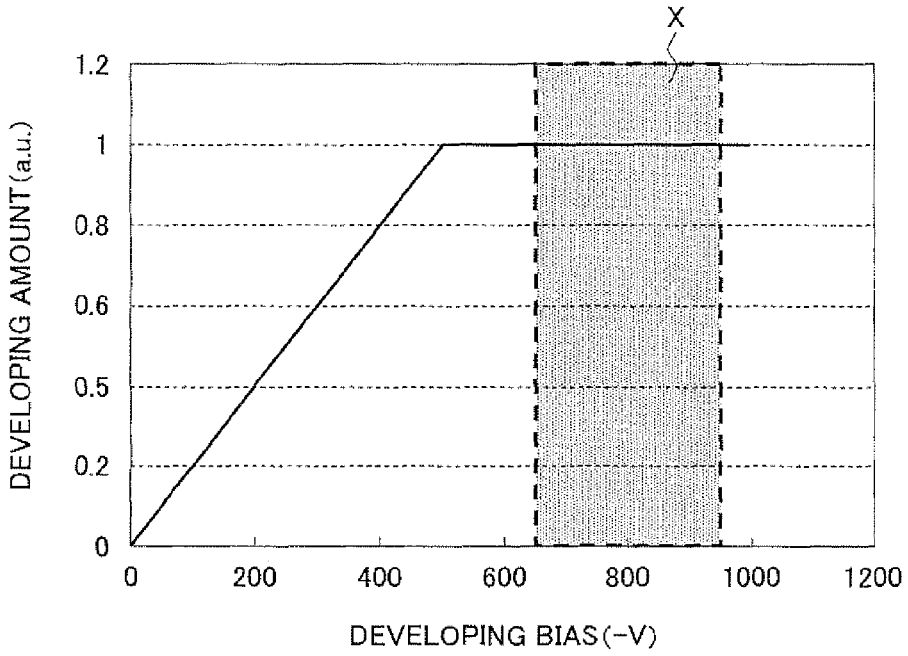
FIG. 7 is a view showing a common relation between a developing bias and a developing amount.

In the present embodiment, a value which a developing amount is saturated is used as a value of a bias voltage Vd applied to the developing roller 12. This will be described based on FIG. 7. The relation between the developing bias (unit: −v) and the developing amount (unit: a.u.) is generally the one as shown in FIG. 7. Note that, when the toner charging amount or the like changes, a saturation potential shifts. However, in a case where the developing bias in a region X of the saturation region enclosed by dots is specified, the developing amount is able to be maintained to be almost constant relative to the variation in the given area. This is an effective technique in a case where the development is performed in an area enclosed with dots.

In the above case, the toner amount which is developed on the photoreceptor 51 is constant, and the value of the toner adhesion amount a×the development efficiency e is constant in the above-described formula (7). Furthermore, the width in the printing portion c, the circumferential speed of the photoreceptor drum h, and the circumferential speed of the developing roller/the circumferential speed of the photoreceptor drum k are the parameters decided in designing a development tank. Therefore, $1\div(a\times c\times e\times h)\times k\times 10^{11}$ is able to be replaced with a constant number A. That is, the formula (7) is able to be rewritten to the following formula.

$$b=A\times(Id+Is)\div d \qquad \text{formula (8)}$$

Then, the printing ratio d at the time of printing is calculated from the number of dots in data, and the toner average charging amount b is thus able to be calculated using the formula (8).

Next, consideration is made on the current flowing in the supply roller 13. In the present configuration, the current Is flowing in the supply roller 13 associates with the movement of the toner peeled from the developing roller 12 by the supply roller 13. Therefore, assuming that a toner average charging amount is b and an amount of a toner peeled by the supply roller in a unit time is f, the current Is flowing in the supply roller 13 is satisfied as follows.

$$Is=b\times f \qquad \text{formula (9).}$$

Moreover, since a numeric value relating to peeling failure due to deterioration or the like of the supply roller 13 is the toner amount f peeled by the supply roller in the unit time in the formula (9), from the above-described formula (9), the following formula is satisfied.

$$f=Is\div b \qquad \text{formula (10)}$$

Note that, for the toner average charging amount b, one obtained by the formula (8) is able to be utilized, and as a result, the toner peeled amount (toner peeled off amount) f is thus obtained from the measured values of the current Id and the current Is.

In this manner, the control portion 16 calculates the toner average charging amount b and the toner peeled amount f based on two current values measured at the time of printing by the first current measuring portion 14 and the second current measuring portion 15, however, a sequence of calculation processing is able to be executed while the parameters required for the above-described calculation formulae and calculations have been stored in a not-shown memory.

Note that, description has been given in the above for the case where the voltage Vs applied to the supply roller 13 and the voltage Vd applied to the developing roller 12 are the same. However, in a case where a difference is provided between the voltage Vs and the voltage Vd, a steady current flows between the supply roller 13 and the developing roller 12, and therefore the toner peeled amount is not able to be obtained accurately by the formula (10). Accordingly, in a case where different bias voltages are applied to the developing roller 12 and the supply roller 13 at the time of printing, a value of a current flowing in the supply roller 13 is measured in advance at the time of non-printing by the second current measuring portion 15 in a state where the same bias voltages are applied to the developing roller 12 and the supply roller 13. Then, at the time of printing, the first current measuring portion 14 and the second current measuring portion 15 measure a value of a current flowing in the developing roller 12 and a value of a current flowing in the supply roller 13, respectively, so that the control portion 16 calculates the toner charging amount based on these two measured current values as well as calculates the toner peeled amount based on this toner charging amount and the current value of the supply roller 13 which is measured in advance at the time of non-printing.

That is, except at the time of printing, for example, at the time of non-printing such as immediately before printing, immediately after printing and between sheets, the current value Is flowing in the supply roller 13 is measured in advance while the voltage of the supply roller 13 is made coincident with the voltage of the developing roller 12, and with use of the toner average charging amount b obtained in printing, the toner peeled amount f may be calculated. In this way, for the value of the current Is in obtaining the toner peeled amount f, the current value Is which has been measured in obtaining the toner average charging amount b is not necessarily used, and there may be deviation of the timings thereof.

Figure 8:
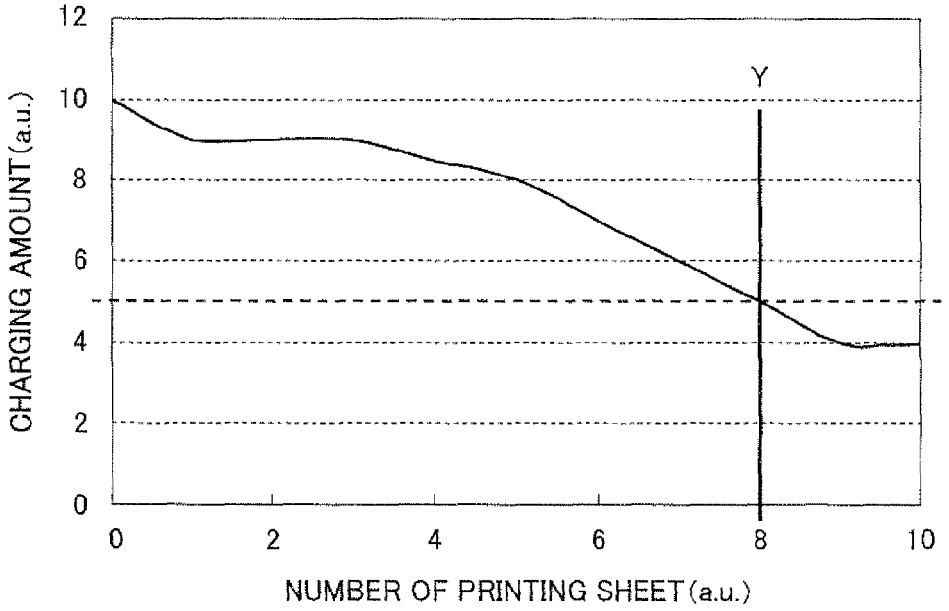
FIG. 8 is a view showing a relation between the number of printing sheets and a toner charging amount.

Here, an obtained result of a relation between the number of printing sheets and the toner average charging amount under a certain condition using the above-described formula (8) is shown in FIG. 8. Note that, the unit for both the toner average charging amount in the vertical axis and the number of printing sheets in the horizontal axis is (a.u.). According to FIG. 8, there is a reducing tendency of the toner average charging amount when the number of printing sheets increases. A usable range of the toner average charging amount is decided by the developing device 1 and the image forming apparatus 100. Here, assuming that the toner average charging amounts up to half of an early period are usable, a point Y is a use limit.

When arrived at this point Y, namely, when the toner average charging amount b calculated by the control portion 16 is reduced to less than a predetermined amount (the half of the early period, here), deterioration in the toner is necessary to be recovered. For example, processing is performed such that the deteriorated toner is forcibly consumed based on the control by the control portion 16 and a new toner is replenished. The developing bias in a region X of the saturation region enclosed by dots shown in the above-described FIG. 7 is applied, and the toner is then shifted to the side of the photoreceptor 51. The shifted toner is discharged through the cleaning device 56 of the photoreceptor 51 (FIG. 1) without being transferred onto a sheet. Thereafter, a new toner is replenished and the toner charging amount is thus able to be recovered. Note that, the toner discharge may not be performed for the entire toner in the development tank. In most cases, there is deterioration in the toner around the developing roller 12 and the supply roller 13, therefore, when the forcible consumption is performed until an amount of the toner around the developing roller 12 and the supply roller 13 is consumed, the toner charging amount is then recovered most of the time.

In this way, when the toner is deteriorated so that the toner charging amount is reduced, problems such as fogging may occur, however, recovering the toner deterioration as described above enables prevention of image deterioration in advance.

Furthermore, the supply roller 13 in contact with the developing roller 12 rotates so that a traveling direction is opposite to the developing roller 12, thus subjected to a great frictional force. Therefore, the surface of the supply roller 13 is worn gradually. Furthermore, on the surface of the supply roller 13, a toner is filled, however there is a case where the toner is pushed deeply into a cell gradually, thus causing hardening of the surface thereof. Reduction in the peeled amount by the supply roller 13 is caused by two factors such as the abrasion mainly on the surface and clogging the cell with the toner. The reduction in the toner peeled amount allows development ghost to be easily caused. Moreover, the factors of reduction in the toner peeled amount serve also as a factor of causing reduction in the toner supply amount to the developing roller 12 at the same time. When the toner supply amount is reduced, in the case of successive printing at the high printing rate, supply of the toner is not satisfied therewith, thus causing reduction in density or thinning in an image in some cases. In such a case, namely, in a case where the toner peeled amount calculated by the control portion 16 is reduced to less than the predetermined amount, the developing device 1 itself is required to be exchanged, therefore, a function to emit a signal notifying a user of the exchange of the developing device 1 may be provided.

In this manner, when the toner peeled amount by the supply roller comes to reduce, image failure such as increasing of the development ghost easily occur, and the occurrence of the image failure is able to be prevented by notifying the user of an appropriate time of exchanging the developing device including the supply roller.

According to the present embodiment, the value of the current flowing in each of the developing roller and the supply roller is measured, so that the toner charging amount on the developing roller and the toner peeled amount by the supply roller are able to be calculated accurately, and which are able to be used to detect the deteriorated state of the toner, the supply roller and the like.

(Second Embodiment)

Figure 9:
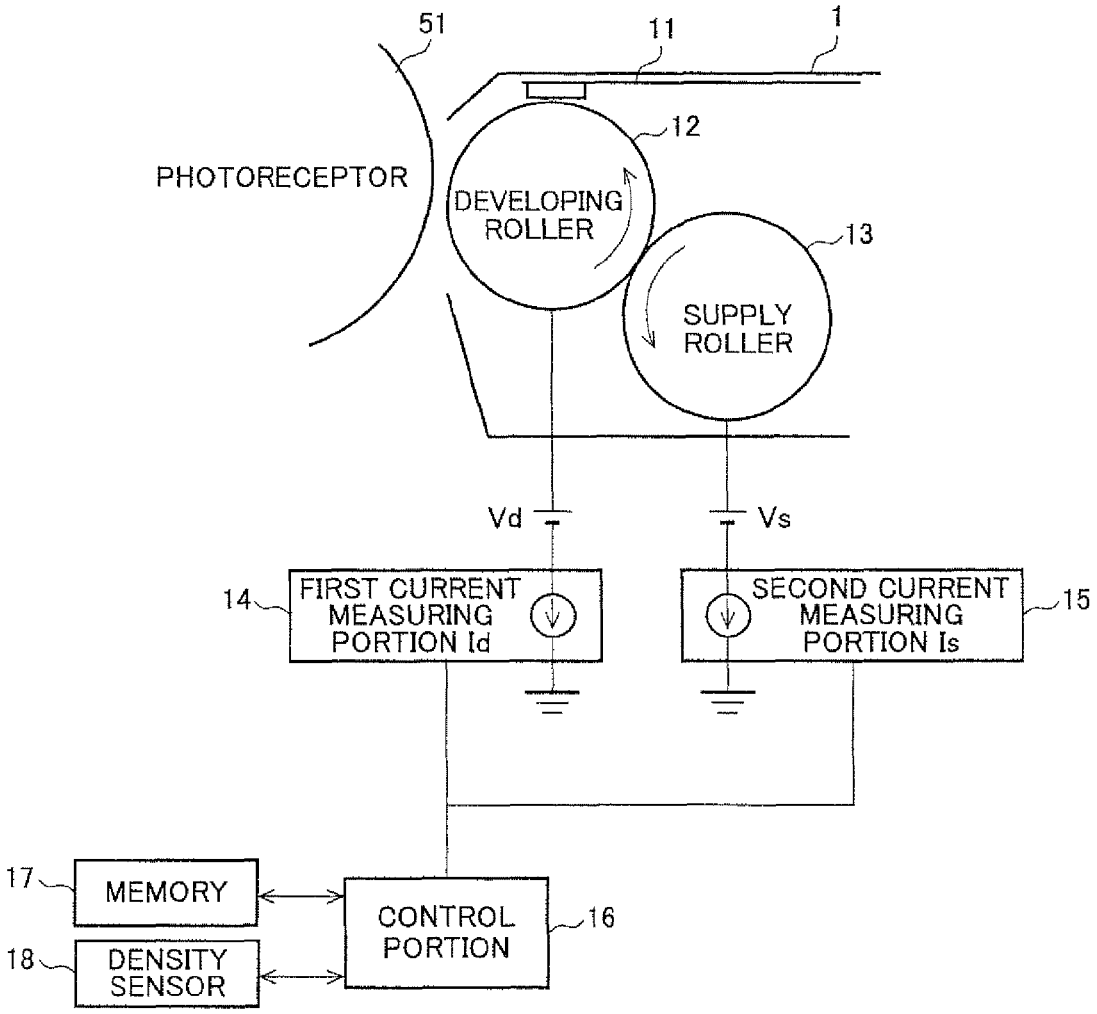
FIG. 9 is a schematic view showing another configuration example of the developing device of the present invention.

FIG. 9 is a schematic view showing another configuration example of the developing device of the present invention, and in the drawing, a reference numeral 17 denotes a memory and a reference numeral 18 denotes a density sensor. In the above-described first embodiment, a state where variation in density is not easily occurred is created by using the developing bias under the conditions of the saturation region. However, when this method is applied, there is a problem that gradation is hard to be produced. Then, image density control by a density patch, which is generally employed, is performed. Specifically, a density patch image with a given area for density detection is read out from the memory 17, and the density patch image is developed on the photoreceptor 51 so that the image density is measured by the density sensor 18. Then, the developing bias applied to the developing roller 12 is adjusted so that the image density measured by the density sensor 18 is a predetermined density. An image density adjustment portion of the present invention is realized by the memory 17 and the density sensor 18. In a state after the developing bias was adjusted in the manner described above, the toner amount to be developed on the photoreceptor 51 is a constant, and therefore, as described in the first embodiment, the toner average charging amount b is able to be obtained by the above-described formula (8). Moreover, the toner peeled amount f is also able to be obtained as with the first embodiment.

Note that, also in the present embodiment, as with the first embodiment, deterioration in the toner and deterioration in the supply roller 13 are able to be detected by the toner average charging amount b and the toner peeled amount f.

According to the present embodiment in this manner, the image density adjustment is performed using the density patch or the like, and thereafter, the value of the current flowing in each of the developing roller and the supply roller is measured so that the toner charging amount and the toner peeled amount are able to be obtained more accurately.

The present system which has been described above is preferable to be used for non-contact development in which the developing roller 12 and the photoreceptor 51 are apart with a certain distance. The system is usable even in the case of contact development, however, there is a current flowing from the developing roller 12 to the photoreceptor 51 in the contact portion, and therefore an error easily occurs in calculating the toner average charging amount. In the case of the non-contact development, the current flowing on the side of the photoreceptor 51 is one only associated with the development of the toner, and the toner average charging amount is thus able to be calculated accurately, so that control using the charging amount is able to be performed accurately.

Furthermore, the present system is preferable to be used for DC development that applies a DC voltage as a bias voltage that is applied to the developing roller 12. In the case where an AC voltage is applied, a toner is reciprocated by an AC electric field between the photoreceptor 51 and the developing roller 12 so that the current flowing in the developing roller 12 becomes an AC current. It is possible to calculate the toner average charging amount by detecting a DC component. However, complex phenomena such as charge change of the toner in reciprocating are included, therefore these phenomena are required to be considered, to be precise. In the case of the DC development, the complex phenomena as with the AC development are not included, and the toner average charging amount is thus able to be obtained with high accuracy, so that the control with high accuracy is able to be performed.

Furthermore, the toner layer regulation blade 11 is preferably a blade in which surface thereof on a side of the developing roller 12 is caused to have insulation properties so that the current does not flow directly. In the case of using the metal blade, there occurs a necessity of considering the current value due to inflow of a charge from the blade. In the case of a blade in which urethane rubber with insulation properties is attached to the metal plate, the current for a blade portion is almost not necessary to be considered, so that the measurement is able to be performed easily.

Hereinabove, as described above, a value of a current flowing in each of a developing roller and a supply roller is measured, so that the toner charging amount on the developing roller and the toner peeled amount by the supply roller are able to be calculated, thus appropriate process control and deterioration detection of the supply roller or the like are performed, whereby enabling to provide a developing device with excellent stability.

The invention claimed is:

1. A developing device of a single-component system which includes a developing roller which supplies a toner to an electrostatic latent image carrier and a supply roller which performs supply of a toner to the developing roller and peeling of a toner from the developing roller, and applies a bias voltage to the developing roller so as to develop an electrostatic latent image formed on the electrostatic latent image carrier with the toner, comprising:

a first current measuring portion which measures a value of a current flowing in the developing roller;

a second current measuring portion which measures a value of a current flowing in the supply roller;

a control portion which calculates a toner charging amount on the developing roller and a toner peeled amount by the supply roller based on measured results by the first current measuring portion and the second current measuring portion; and wherein in a case where same bias voltages are applied to the developing roller and the supply roller at the time of printing upon a toner movement to a side of the electrostatic latent image carrier, the first current measuring portion and the second current measuring portion measure a value of a current flowing in the developing roller and a value of a current flowing in the supply roller, respectively at the time of printing upon the toner movement to the side of the electrostatic latent image carrier, so that the control portion calculates the toner charging amount and the toner peeled amount based on the two measured current values.

2. The developing device as defined in claim 1, wherein an image density adjustment portion which adjusts the bias voltage applied to the developing roller so that an image developed on the electrostatic latent image carrier is a predetermined density is provided, and the first current measuring portion and the second current measuring portion measure, after adjustment of an image density performed by the image density adjustment portion, a value of a current flowing in each of the developing roller and the supply roller.

3. The developing device as defined in claim 1, wherein in a case where different bias voltages are applied to the developing roller and the supply roller at the time of printing, a value of a current flowing in the supply roller is measured in advance at the time of non-printing by the second current measuring portion in a state where the same bias voltages are applied to the developing roller and the supply roller, and the first current measuring portion and the second current measuring portion measure a value of a current flowing in the developing roller and a value of a current flowing in the supply roller, respectively at the time of printing, so that the control portion calculates the toner charging amount based on the two measured current values as well as calculates the toner peeled amount based on the toner charging amount and the value of the current of the supply roller which is measured in advance at the time of non-printing.

4. The developing device as defined in claim 1, wherein in a case where the toner charging amount calculated by the control portion is reduced to less than a predetermined amount, recovery of deterioration in the toner: is performed.

5. The developing device as defined in claim 4, wherein the recovery of the deterioration in the toner is processing in which the deteriorated toner is forcibly consumed and a new toner is replenished.

6. The developing device as defined in claim 1, wherein in a case where the toner peeled amount calculated by the control portion is reduced to less than a predetermined amount, a signal to prompt exchange of the development device is emitted.

7. The developing device as defined in claim 1, wherein the developing roller is in non-contact with the electrostatic latent image carrier.

8. The developing device as defined in claim 1, wherein the bias voltage applied to the developing roller is a direct current voltage.

9. The developing device as defined in claim 1, wherein a toner layer regulation blade for regulating the toner supplied to the developing roller to a predetermined amount is provided and a surface of the toner layer regulation blade on a side of the developing roller has insulation properties.

10. An image forming apparatus comprising the developing device as defined in claim 1.

11. A developing device of a single-component system which includes a developing roller which supplies a toner to an electrostatic latent image carrier and a supply roller which performs supply of a toner to the developing roller and peeling of a toner from the developing roller, and applies a bias voltage to the developing roller so as to develop an electrostatic latent image formed on the electrostatic latent image carrier with the toner, comprising:

a first current measuring portion which measures a value of a current flowing in the developing roller;

a second current measuring portion which measures a value of a current flowing in the supply roller; and a control portion which calculates a toner charging amount on the developing roller and a toner peeled amount by the supply roller based on measured results by the first current measuring portion and the second current measuring portion; and wherein in a case where different bias voltages are applied to the developing roller and the supply roller at the time of printing, a value of a current flowing in the supply roller is measured in advance at the time of non-printing by the second current measuring portion in a state where the same bias voltages are applied to the developing roller and the supply roller, and the first current measuring portion and the second current measuring portion measure a value of a current flowing in the developing roller and a value of a current flowing in the supply roller, respectively at the time of printing, so that the control portion calculates the toner charging amount based on the two measured current values as well as calculates the toner peeled amount based on the toner charging amount and the value of the current of the supply roller which is measured in advance at the time of non-printing.

12. The developing device as defined in claim 11, wherein the developing roller is in non-contact with the electrostatic latent image carrier.

13. The developing device as defined in claim 11, wherein the bias voltage applied to the developing roller is a direct current voltage.

14. The developing device as defined in claim 11, wherein a toner layer regulation blade for regulating the toner supplied to the developing roller to a predetermined amount is provided and a surface of the toner layer regulation blade on a side of the developing roller has insulation properties.

15. An image forming apparatus comprising the developing device as defined in claim 11.

* * * * *